United States Patent [19]

Maki et al.

[11] Patent Number: 4,778,522

[45] Date of Patent: Oct. 18, 1988

[54] WEAR RESISTANT IRON-BASE SINTERED ALLOY

[75] Inventors: Yoshihiro Maki, Miura; Makoto Kano, Yokohama; Akira Fujiki, Yokosuka; Ichiro Tanimoto, Yokohama; Hiroyuki Endo, Abiko; Yukata Ikenoue, Matsudo; Kei Ishii, Yokohama, all of Japan

[73] Assignees: Nissan Motor Co., Ltd., Yokohama; Hitachi Powdered Metals Co., Ltd., Matsudo, both of Japan

[21] Appl. No.: 23,631

[22] Filed: Mar. 9, 1987

[30] Foreign Application Priority Data

Mar. 12, 1986 [JP] Japan ..... 61-54150

[51] Int. Cl.[4] ..... C22C 29/06; C22C 29/08

[52] U.S. Cl. ..... 75/238; 75/241

[58] Field of Search ..... 75/238, 241

[56] References Cited

U.S. PATENT DOCUMENTS

| | | | |
|---|---|---|---|
| 4,318,733 | 3/1982 | Ray et al. | 75/5 BA |
| 4,345,943 | 8/1982 | Takahashi et al. | 75/238 |
| 4,348,232 | 7/1982 | Hiraoka et al. | 75/238 |
| 4,487,630 | 12/1984 | Crook et al. | 75/238 |
| 4,599,109 | 7/1986 | Kawai et al. | 75/238 |

FOREIGN PATENT DOCUMENTS

| | | | |
|---|---|---|---|
| 57-2867 | 1/1982 | Japan | 75/238 |
| 57-92158 | 8/1982 | Japan | 75/238 |
| 58-22358 | 2/1983 | Japan | 75/238 |
| 58-22359 | 2/1983 | Japan | 75/238 |
| 58-130260 | 8/1983 | Japan | 75/238 |
| 2007710 | 5/1979 | United Kingdom . | |
| 2011470 | 7/1979 | United Kingdom . | |
| 2116207 | 9/1983 | United Kingdom . | |

OTHER PUBLICATIONS

JICST M86081366, pp. 295–310; Materials Engineering Department Rensselaer Polytechnic Institute; K. S. Hwang et al.

Technical Research Laboratory, Toyo Kohan Co., Ltd.: pp. 1073–1076; T. Ide et al.

Technical Research Laboratory, Toyo Kohan Co., Ltd., pp. 1077–1082; K. Takagi et al.

*Primary Examiner*—John F. Terapane

*Assistant Examiner*—Eric Jongensen

*Attorney, Agent, or Firm*—Foley & Lardner, Schwartz, Jeffery, Schwaab, Mack, Blumenthal & Evans

[57] ABSTRACT

A wear resistant iron-base sintered alloy consists essentially of at least one selected from the group consisting of molybdenum and tungsten, ranging from 5 to 20% by weight, chromium ranging from 2 to 10% by weight, silicon ranging from 0.1 to 0.9% by weight, manganese ranging not more than 0.7% by weight, phosphorus ranging not more than 0.05% by weight, carbon ranging from 0.1 to 0.8% by weight, boron ranging from 0.5 to 2.0% by weight, and balance including iron and an impurity, so that fine multiple carbide, multiple boride, and/or multiple carbide-boride can be homogeneously dispersed as hard grains in the structure of a matrix, thereby exhibiting excellent wear resistance, scuffing resistance and pitting resistance.

8 Claims, No Drawings

WEAR RESISTANT IRON-BASE SINTERED ALLOY

BACKGROUND OF THE INVENTION

1. Field of the Invention

The present invention relates generally to an iron-base sintered alloy used as a material for mechanical parts, and more particularly to an iron-base sintered alloy which exhibits excellent wear resistance and concordance with a contacting member in case of being used as the material for slidingly contacting sections of, for example, rocker arms and tappets of a valve operating mechanism of an internal combustion engine.

2. Description of the Prior Art

In recent years, wear of the parts of a valve operating mechanism of an internal combustion engine has become an issue with the requirement of increasing engine speed and engine output power, in which high durability of rocker arm and tappet at their slidingly contacting part to which a camshaft slidingly contacts has been particularly required. The slidingly contacting part of rocker arm and tappet is usually subjected to a high bearing pressure and therefore is required to have excellent wear resistance, scuffing resistance, pitting resistance, and concordance with the material of the camshaft.

In this regard, a rocker arm has hitherto been used, for example, the type made of chilled cast iron, the type wherein surface treatment such as Cr-plating and padding of self-fluxing or autogenous alloy upon thermal spraying is made, and the type formed of liquid phase sintered of compressed body of Fe-Cr-C high alloy powder.

However, of these types the rocker arm made of chilled cast iron is problematical because of being lower in pitting resistance and wear resistance. The Cr-plated rocker arm is problematical because of a peeling tendency of the plated layer. The rocker arm provided with the thermal spray padding is problematical because of scuffing and providing wear to a camshaft as an opposite member, and the like. The rocker arm formed of Fe-Cr-C sintered alloy usually exhibits considerably good characteristics as compared with the above-mentioned rocker arms; however, not only is its wear resistance insufficient but also the abrasion amount of the camshaft increases in case where high bearing pressure is applied to the rocker arm and the camshaft, thus failing to satisfy required characteristics for the material of mechanical parts of valve operating mechanism.

SUMMARY OF THE INVENTION

A wear resistant iron-base sintered alloy according to the present invention consists essentially of at least one selected from the group consisting of molybdenum and tungsten, ranging from 5 to 20% by weight, chromium ranging from 2 to 10% by weight, silicon ranging from 0.1 to 0.9% by weight, manganese ranging not more than 0.7% by weight, phosphorus ranging not more than 0.05% by weight, carbon ranging from 0.1 to 0.8% by weight, boron ranging from 0.5 to 2.0% by weight, and the balance including iron and an impurity.

In such a sintered alloy, fine multiple carbide, multiple boride and/or multiple carbide-boride can be homogeneously dispersed as hard grains in the structure of a matrix. Accordingly, in cases where this sintered alloy is used for a material of a mechanical component part to which a high bearing pressure is applied, the bearing pressure is effectively distributed under the action of the above-mentioned hard grains, so that the sintered alloy exhibits excellent wear resistance, scuffing resistance and pitting resistance.

DETAILED DESCRIPTION OF THE INVENTION

According to the present invention, a wear resistant iron-base sintered alloy consists essentially of at least one selected from the group consisting of molybdenum and tungsten, ranging from 5 to 20% by weight, chromium ranging from 2 to 10% by weight, silicon ranging from 0.1 to 0.9% by weight, manganese ranging not more than 0.7% by weight, phosphorus ranging not more than 0.05% by weight, carbon ranging from 0.1 to 0.8% by weight, boron ranging from 0.5 to 2.0% by weight, and balance including iron and an impurity.

The present invention has been accomplished on the basis of the following new information founded by inventors: Of various wear resistant iron-base alloys, one of the type wherein fine carbide, boride and/or carbide-boride are homogeneously dispersed in the structure of a matrix has excellent wear resistance in sliding contact, in which it exhibits very excellent performance particularly, for example, in case of being used as a sliding contacting part of a rocker arm. The carbide-boride is a solid solution of carbide and boride, a carbide a part of which is substituted by boride, or a boride a part of which is substituted by carbide.

Reasons for defining the compositions of the wear resistance iron-base sintered alloy according to the present invention as mentioned above will be hereinafter discussed.

Mo and W:

Mo (molybdenum) and W (tungsten) are combined with C (carbon) and B (boron) to form multiple carbide, multiple boride, and multiple carbide-boride. Fe (iron) and Cr (chromium) also combine with C and B to form multiple carbide, multiple boride and multiple carbide-boride. Such multiple carbide, multiple boride and multiple carbide-boride provide wear resistance to the sintered alloy, in which a part of them exists in the matrix in form of solid solution thereby to strengthen the matrix and to improve temper hardenability. However, if the content of Mo and W is less than 5% by weight, such advantageous effect cannot be obtained to a desirable extent. Even if the content exceeds 20% by weight, a further improvement of such effect cannot be recognized while providing disadvantage from the economical view point. Accordingly, the content of at least one of Mo and W is selected within a range from 5 to 20% by weight.

Cr:

Cr (chromium) forms multiple carbide and multiple boride together with Mo, W and the like, thereby improving wear resistance of the sintered alloy, improving hardenability upon existing in the matrix in the form of solid solution, improving temper hardening ability, and improving corrosion resistance of the matrix. If the content of Cr is less than 2%, such advantegeous effect cannot be recognized. If the content exceeds 10%, not only is there no further improvement in such advantageous effect, but also the mechanical strength of the sintered alloy is lowered to unavoidably increase attacking ability against an opposite member to which the sintered alloy contacts. Thus, the content of Cr is selected within a range from 2 to 10 % by weight.

Si:

If the content of Si (silicon) is less than 0.1% by weight, deoxidation effect is less thereby to increase oxygen content in the powder to be sintered, thus lowering sintering ability while coarse plate-shape carbide of $M_2C$ tends to crystallize thereby to lower concordance with the opposite meber. Even if the content exceeds 0.9% by weight, deoxidation effect cannot be improved while powder particle is rounded thereby lowering the compactability. Thus, the content of Si is within a range from 0.1 to 0.9% by weight.

Mn:

Mn (manganese) has deoxidation effect like the above-mentioned Si and therefore lowers oxygen content in the powder to be sintered thereby to improve sintering ability of the powder. If the content of Mn exceeds 0.7% by weight, the shape of the powder is rounded thereby lowering moulding ability of the powder while allowing edge sections of a compacted or sintered body to tend to break off. Thus, the content of Mn is selected within a range not more than 0.7% by weight.

P:

In general, a method in which about 0.2 to 0.8% by weight of P (phosphorus) is added as an element for promoting sintering has been used in case of wear resistant sintered alloys. However, according to the present invention, the content of P is selected within a range not more than 0.05% by weight for the reasons set forth below: If the content of P exceeds 0.05% by weight, multiple boride or multiple carbide-boride are coarsened thereby to lower concordance with the opposite member; and additionally multiple boride or multiple carbide-boride unavoidably crystallize in the form of a network at the grain boundary thereby lowering strength of the alloy and lowering pitting resistance of the alloy.

C:

A part of C (carbon) combines with carbide forming elements such as Mo, W, Cr and V to form multiple carbide thereby improving wear resistance of the alloy. The remainder of C exists in the form of solid solution in the matrix thereby to provide high room temperature hardness and strength. However, if the content of C is less than 0.1% by weight, such advantageous effect cannot be recognized. If the content exceeds 0.8% by weight, multiple boride increases in crystallized amount and is coarsened thereby to lower concordance with the opposite member. Thus, the content of C is selected within a range from 0.1 to 0.8% by weight.

This C is preferably added in the form of Fe-Mo-W-Cr-V-Si-(Mn)-(Co)-C atomized alloy powder which is subjected to vacuum annealing. If C is added singly in the form of graphite powder, it combines with Fe-B and Fe-Cr-B which are added as a source of B (boron) as discussed after, so that coarse carbide-boride crystallizes out along the grain boundary during sintering thereby increasing attacking ability against the opposite member. In contrast with this, in case where C is added in the form of vacuum-annealed Fe-Mo-W-Cr-V-Si-(Mn)-(Co)-C atomized powder, most of C combines with Mo, W, Cr, V, Fe and the like thereby to crystallize out as fine multiple carbide in the atomized alloy powder during vacuum annealing after atomization. Accordingly, even if Fe-B and Fe-Cr-B are added, they combine with multiple carbide located at or near the grain boundary during sintering thereby only forming multiple carbide-boride slightly larger than former multiple carbide, so that fine multiple carbide in grain remains as it is even after sintering. The thus remaining fine multiple carbide is homogeneously dispersed together with fine multiple boride which has crystallized out owing to decomposition and crystallization made between Fe-B, Fe-Cr-B and Mo, W in the atomized alloy powder, thus giving a structure peculiar to the sintered alloy according to the present invention.

B:

B (boron) forms multiple boride upon combining with Mo, W, V, Cr, and Fe, thereby providing wear resistance, in which a part of B exists in the form of solid solution in the matrix thereby to improve hardenability of the alloy. Additionally, a part of the above-mentioned multiple boride combines with C to form multiple carbide-boride thereby improving wear resistance of the alloy.

Thus, B is an essential element to form fine multiple boride or multiple carboride-boride thereby improving wear resistance and concordance of the sintered alloy according to the present invention. However, if the content of B is less than 0.5% by weight, such advantageous effect cannot be recognized. Even if the content exceeds 2.0% by weight, not only a further improvement of the advantageous effect cannot be recognized but also multiple boride is coarsened thereby to lower concordance with the opposite member. Thus, the content of B is selected within a range from 0.5 to 2.0% by weight.

Although the content of B according to the present invention is required to be within the range from 0.5 to 2.0% by weight, it is preferable that a relationship of [Mo+W content (in atomic weight)]/[B content (in atomic weight)]=0.8−1.5 is established between the content of B and the content of Mo+W, for the purpose of obtaining particularly excellent characteristics.

Because, if the above-mentioned atomic weight ratio exceeds 1.5, production amount of multiple boride is less and therefore concordance as a feature of the present invention is lowered. If the atomic weight ratio is smaller than 0.8, multiple boride is coarsened and cystallizes out in the form of a network at the grain boundary, so that concordance of the alloy with the opposite member lowers while pitting resistance of the alloy lowers. Additionally, it is preferable to add B in the form of Fe-B or Fe-Cr-B alloy powder.

V, Nb, Ta:

V (vanadium), Nb (niobium), and Ta (tantalum) combine with C together with Fe and Cr thereby to form very hard multiple carbide and form multiple carbide and multiple boride of the type wherein a part of Mo and W is substituted with them thereby providing wear resistance, in which a part of them exists in the form of solid solution in the matrix thereby strengthening the matrix and improving temper hardenability. Additionally, V, Nb, and Ta prevents coarsening of crystal grain during sintering and coarsening of carbide. If the content of at least one of V, Nb, and Ta is less than 0.5% by weight, such advantageous effect is hardly recognized so that wear resistance and strength of the alloy are lowered. Even if the content exceeds 8% by weight, a further improvement cannot be recognized while providing economical disadvantage. Thus, in the case where at least one of V, Nb, and Ta is preferably added, the content of at least one of them is selected within a range from 0.5 to 8% by weight.

In addition to the above-discussed elements, at least one of Ti (titanium), Zr (zirconium), Hf (hafnium), Co (cobalt) and the like as boride forming elements may be added in an amount or content within a range not more than 12% by weight, if necessary. Particularly Co of such elements not only forms multiple boride upon being substitued with a part of Mo, W and the like but also exists in the form of solid solution in the matrix thereby improving red heat hardness of the alloy. Accordingly, addition of Co is particularly effective in case where wear resistance upon being heated is required.

Furthermore, Ni (nickel) may be added in an amount within a range where the matrix is not austenitized. Because addition of Ni improves corrosion resistance of the matrix and therefore is effective particularly for parts subjected to severe corrosion wear, such as rocker arms and hydraulic lifters of valve operating mechanism of diesel engine equipped with an EGR (Exhaust Gas Recirculation) system. However, if added amount of Ni is too much so that the matrix is austenitized, the alloy not only lowers in hardness but also increases in adhesion with the opposite member. Thus, it is preferable to add at least one of V, Nb, Ta, Ti, Zr, Hf, Co, and Ni in an amount within a range not more than 20% by weight in total.

Moreover, it is preferable that the sintered alloy of the present invention has a Rockwell C-scale hardness number ranging from 50 to 65. Because if the hardness number is smaller than 50, wear resistance of the sintered alloy is insufficient. If the hadness number exceeds 65, concordance of the sintered alloy with the opposite member lowers to an undesired level.

Additionally, it is also preferable that the sintered alloy of the present invention have a theoretical density ratio more than 90%. If the theoretical density ratio is less than 90%, the matrix is lower in strength and has large pores, so that the matrix is liable to be broken off owing to the notch effect of the pores thereby to cause pitting wear.

EXAMPLES

In order to evaluate the wear resistant iron-base sintered alloy according to the present invention, Examples of the present invention will be discussed hereinafter in comparison with Comparative Examples which are out side the scope of the present invention.

Used as raw material powers were vacuum-annealed Fe-Cr-Mo-W-Si-C atomized powder (V, Nb, Ta, and Co were added if necessary) having a particle size of −100 mesh, Fe-Mo powder or pure Mo powder each having a particle size of −325 mesh, Fe-W powder or pure W powder each having a particle size of −325 mesh, Fe-B alloy powder (20% by weight of B contained) having a particle size of −250 mesh, Fe-26% P alloy powder having a particle size of −250 mesh, ferrotitanium, ferrozirconium, ferrohafnium alloy powders each having a particle size of −250 mesh, carbonyl nickel powder having a particle size of −325 mesh, and the like. These raw material powders were suitably blended to prepare a variety of sample powders corresponding to sintered alloys having compositions shown in Tables 1A and 1B. Zinc stearate as lubricant was added to the sample powder and mixed to obtain mixed powder. This mixed powder was moulded into a predetermined shape under a pressure of 7 tons/cm$^2$. The thus obtained compressed powder body was then maintained in vacuum at 1150°-1250° C. for 60 minutes to be sintered thereby to obtain a sintered alloy. Thereafter, the sintered alloy was subjected to quenching and tempering treatments to obtain Example alloys (as the Examples) Nos. 1-16 according to the present invention and Comparative Example Alloys (as the Comparative Examples) Nos. 1-10 as shown in Tables 1A and 1B.

Subsequently, each of the resultant Example alloys Nos. 1-16 and Comparative Example alloys Nos. 1-10 was used as a slidingly contacting part (contacting with a camshaft) of a rocker arm, housing therein a lash adjustor, of a valve operating mechanism of a four-cylinder OHC gasoline-powered engine. An abrasion test conducted by operating the thus arranged engine under conditions where the camshaft was made of chilled cast iron, engine speed was 650 rpm, lubricating oil was one (for gasoline-powered engine) which had been used for 10,000 km cruising, operating time was 600 hrs. Other conditions of this test were the same as in actual vehicle cruising. After this test, abrasion amount of the rocker arm slidingly contacting part and of the camshaft as the opposite member were measured, and production status of scuffing and pitting at the slidingly contacting part was observed. The thus obtained measured and observed results are shown in Tables 1A and 1B. Additionally, for the purpose of comparison, Table 1B also shows similar results obtained after conducting abrasion tests under the same conditions as in Example Alloys and Comparative Example Alloys, with respect to Conventional Material No. 1 in which a rocker arm was made of chilled cast iron, Conventional Material No. 2 in which a rocker arm was plated with Cr, and Conventional Material No. 3 in which a rocker arm was made of Fe-12Cr-C sintered alloy.

TABLE 1A

| Alloys | | Composition (wt %) | | | | | | | | | | | | | | | | | Rocker arm wear depth | Cam-shaft wear depth | |
|---|---|---|---|---|---|---|---|---|---|---|---|---|---|---|---|---|---|---|---|---|---|
| Kind | No. | Fe | Mo | W | Cr | Si | Mn | V | P | C | B | No | Ta | Ti | Zr | Hf | Co | Ni | (mm) | (mm) | Appearance |
| Example alloy (present invention) | 1 | balance | 9.5 | 1.5 | 4.0 | 0.3 | 0.3 | — | 0.01 | 0.4 | 1.0 | — | — | — | — | — | — | — | 0.06 | 0.04 | scuffing and pitting not recognized |
| | 2 | balance | — | 12.0 | 2.5 | 0.35 | 0.1 | — | 0.01 | 0.7 | 0.6 | — | — | — | — | — | 5.0 | — | 0.05 | 0.03 | |
| | 3 | balance | 13.0 | — | 4.0 | 0.3 | 0.3 | — | 0.01 | 0.5 | 1.3 | — | — | — | — | — | — | — | 0.04 | 0.03 | |
| | 4 | balance | 4.0 | 2.0 | 4.0 | 0.3 | 0.3 | — | 0.005 | 0.6 | 0.6 | 2.5 | — | — | — | — | — | — | 0.04 | 0.02 | |
| | 5 | balance | 9.5 | 1.5 | 4.0 | 0.3 | 0.3 | 2.5 | 0.01 | 0.4 | 1.0 | — | — | — | — | — | — | — | 0.01 | 0.03 | |
| | 6 | balance | — | 12.0 | 2.5 | 0.35 | 0.1 | 7.0 | 0.01 | 0.7 | 0.6 | — | — | — | — | — | 5.0 | — | 0.01 | 0.02 | |
| | 7 | balance | 13.0 | — | 4.0 | 0.3 | 0.3 | 2.5 | 0.01 | 0.5 | 1.3 | | — | — | — | — | — | — | 0.01 | 0.03 | |
| | 8 | balance | 17.5 | 2.0 | 4.0 | 0.3 | 0.3 | — | 0.01 | 0.5 | 1.9 | — | 3.0 | — | — | — | — | — | 0.005 | 0.02 | |
| | 9 | balance | 9.5 | 2.0 | 8.0 | 0.3 | 0.3 | 2.5 | 0.01 | 0.4 | 1.0 | — | — | — | — | — | — | 2.0 | 0.02 | 0.03 | |
| | 10 | balance | 9.5 | 2.0 | 2.5 | 0.5 | — | 2.5 | 0.01 | 0.4 | 1.0 | 4.0 | — | — | — | 0.5 | — | — | 0.02 | 0.03 | |
| | 11 | balance | 9.5 | 2.0 | 4.0 | 0.15 | 0.3 | 2.5 | 0.01 | 0.5 | 1.0 | — | — | — | — | — | — | — | 0.03 | 0.03 | |
| | 12 | balance | 9.5 | 2.0 | 4.0 | 0.3 | 0.3 | 0.7 | 0.01 | 0.5 | 1.0 | — | — | 0.5 | — | — | — | — | 0.03 | 0.03 | |
| | 13 | balance | 9.5 | 2.0 | 4.0 | 0.3 | 0.3 | 7.0 | 0.01 | 0.5 | 1.0 | — | — | — | — | — | — | — | 0.005 | 0.04 | |
| | 14 | balance | 9.5 | 2.0 | 4.0 | 0.3 | 0.3 | 2.5 | 0.04 | 0.5 | 1.0 | — | — | — | — | — | — | — | 0.03 | 0.05 | |
| | 15 | balance | 9.5 | 2.0 | 4.0 | 0.3 | 0.3 | 2.5 | 0.01 | 0.2 | 1.0 | — | — | — | — | — | — | — | 0.03 | 0.01 | |

TABLE 1A-continued

| Alloys | | Composition (wt %) | | | | | | | | | | | | | | | | | Rocker arm wear depth | Cam-shaft wear depth | |
|---|---|---|---|---|---|---|---|---|---|---|---|---|---|---|---|---|---|---|---|---|---|
| Kind | No. | Fe | Mo | W | Cr | Si | Mn | V | P | C | B | No | Ta | Ti | Zr | Hf | Co | Ni | (mm) | (mm) | Appearance |
| | 16 | balance | 4.0 | 10.0 | 4.0 | 0.3 | 0.3 | 3.5 | 0.01 | 0.7 | 0.9 | 2.0 | 2.0 | — | 0.5 | — | 10.0 | — | 0.01 | 0.02 | |

TABLE 1B

| Alloys | | Composition (wt %) | | | | | | | | | | | |
|---|---|---|---|---|---|---|---|---|---|---|---|---|---|
| Kind | No. | Fe | Mo | W | Cr | Si | Mn | V | P | C | B | Nb | Ta |
| Comparative example alloy | 1 | balance | 3.0 | 1.5 | 4.0 | 0.3 | 0.3 | 2.5 | 0.01 | 0.5 | 0.6 | — | — |
| | 2 | balance | 9.5 | 2.0 | 1.5 | 0.3 | 0.3 | 2.5 | 0.01 | 0.5 | 0.1 | — | — |
| | 3 | balance | 9.5 | 2.0 | 15.0 | 0.3 | 0.3 | 2.5 | 0.01 | 0.5 | 1.0 | — | — |
| | 4 | balance | 9.5 | 2.0 | 4.0 | 1.0 | 0.8 | 2.5 | 0.01 | 0.5 | 1.0 | — | — |
| | 5 | balance | 9.5 | 2.0 | 4.0 | 1.0 | 0.3 | 2.5 | 0.3 | 0.5 | 1.0 | — | — |
| | 6 | balance | 9.5 | 2.0 | 4.0 | 0.3 | 0.3 | 2.5 | 0.01 | 0.05 | 1.0 | — | — |
| | 7 | balance | 9.5 | 2.0 | 4.0 | 0.3 | 0.3 | 2.5 | 0.01 | 1.5 | 1.0 | — | — |
| | 8 | balance | 9.5 | 2.0 | 4.0 | 0.3 | 0.3 | 2.5 | 0.01 | 0.5 | 0.3 | — | — |
| | 9 | balance | 9.5 | 2.0 | 4.0 | 0.3 | 0.3 | 2.5 | 0.01 | 0.5 | 2.5 | — | — |
| | 10 | balance | 9.5 | 2.0 | 4.0 | 0.05 | — | 2.5 | 0.01 | 0.5 | 1.0 | — | — |
| Conventional material | 1 | chilled casting | | | | | | | | | | | |
| | 2 | Cr—plating | | | | | | | | | | | |
| | 3 | Fe—12Cr—1.0Mo—2V—0.4Si—0.4P—2.5C sintered alloy | | | | | | | | | | | |

| Alloys | | Composition (wt %) | | | | | Rocker arm wear depth | Cam-shaft wear depth | |
|---|---|---|---|---|---|---|---|---|---|
| Kind | No. | Ti | Zr | Hf | Co | Ni | (mm) | (mm) | Appearance |
| Comparative example alloy | 1 | — | — | — | — | — | 0.06 | 0.10 | slight scuffing recognized |
| | 2 | — | — | — | — | — | 0.07 | 0.11 | normal |
| | 3 | — | — | — | — | — | 0.04 | 0.06 | slight scuffing recognized |
| | 4 | — | — | — | — | — | 0.15 | 0.13 | pitting recognized, edge section slightly broken off |
| | 5 | — | — | — | — | — | 0.11 | 0.21 | serious cam scuffing recognized |
| | 6 | — | — | — | — | — | 0.28 | 0.18 | scuffing recognized |
| | 7 | — | — | — | — | — | 0.03 | 0.15 | normal |
| | 8 | — | — | — | — | — | 0.16 | 0.19 | serious scuffing recognized |
| | 9 | — | — | — | — | — | 0.005 | 0.25 | large cam scuffing recognized |
| | 10 | — | — | — | — | — | 0.15 | 0.14 | pitting recognized |
| Conventional material | 1 | chilled casting | | | | | 0.44 | 0.35 | serious scuffing and pitting |
| | 2 | Cr—plating | | | | | 0.28 | 0.22 | recognized |
| | 3 | Fe—12Cr—1.0Mo—2V—0.4Si—0.4P—2.5C sintered alloy | | | | | 0.08 | 0.14 | slight scuffing recognized |

As is apparent from Tables 1A and 1B, in the cases of the chilled casting made rocker arm, the Cr-plated rocker arm, and the Fe-12Cr-C sintered alloy made rocker arm as shown in Table 1B, considerable wear was produced at their slidingly contacting part and also in the camshaft as the opposite member, since the abrasion test was conducted under the very severe condition. Additionally, scuffing and pitting were also produced on the surface of them.

In the cases where the rocker arms were made of the sintered alloys having compositions outside the ranges of the present invention as shown in Table 1A, considerable wear was produced both in each rocker arm and the slidingly contacting rocker arm while scuffing and pitting were produced in them. Thus, the rocker arms made of the conventional materials and of Comparative Example Alloys both did not exhibit sufficient performance to meet the requirements.

In contrast with this, all the rocker arms made of the Example Alloys according to the present invention exhibited excellent wear resistance and did not damage the cam surface of the camshaft as the opposite member. In addition, they were very excellent in scuffing resistance and pitting resistance.

While the Example Alloys shown and described has a matrix formed of tempered martensite structure made by heat treatment, it will be understood that the matrix may be formed of the structure of bainite, pearlite, bainite-pearlite or the like by suitably selecting heat treatment condition.

Although the alloys of the present invention have been exemplified as being used as the slidingly conacting part of rocker arm, it will be appreciated that they may be used for other parts to which high bearing pressure is applied, for example, valve tappets, camshaft cams, valve sleeves or guides and valve seats thereby exhibiting high wear resistance.

What is claimed is:

1. A wear resistant iron-base sintered alloy consisting essentially of at least one selected from the group consisting of molybdenum and tungsten, ranging from 5 to 20% by weight, chromium ranging from 2 to 10% by weight, silicon ranging from 0.1 to 0.9% by weight, manganese ranging not more than 0.7% by weight, phosphorus ranging not more than 0.05% by weight, carbon ranging from 0.1 to 0.8% by weight, boron ranging from 0.5 to 2.0% by weight, and balance including iron and an impurity.

2. A wear resistant iron-base sintered alloy as claimed in claim 1, further consisting essentially of at least one selected from the group consisting of vanadium, niobium, and tantalum, ranging from 0.5 to 8% by weight.

3. A wear resistant iron-base sintered alloy as claimed in claim 2, further consisting essentially of at least one selected from the group consisting of titanium, zirconium, hafnium, and cobalt, ranging not more than 12% by weight.

4. A wear resistant iron-base sintered alloy as claimed in claim 1, wherein said carbon and boron are present as a solid solution of carbide and boride.

5. A wear resistant iron-base sintered alloy as claimed in claim 4, wherein said carbide and boride are homogeneously dispersed as hard grains in the sintered alloy.

6. A wear resistance iron-base sintered alloy as claimed in claim 1, further consisting essentialy of at least one selected from the group consisting of vanadium, niobium, tantalum, titanium, zirconium, hafnium, cobalt and nickel, ranging not more than 20% by weight.

7. A wear resistant iron-base sintered alloy as claimed in claim 1, wherein the ratio in atomic weight between total of molybdenum and tungsten and boron is 8:10 to 15:10.

8. A wear resistant iron-base sintered allow as claimed in claim 1, wherein said sintered alloy has a Rockwell C-scale hardness number ranging from 50 to 65.

* * * * *